US006651897B1

(12) United States Patent
Porrill et al.

(10) Patent No.: US 6,651,897 B1
(45) Date of Patent: Nov. 25, 2003

(54) SUSPENDED RAIL FASTENING ASSEMBLY

(75) Inventors: John Phillip Porrill, Godalming (GB); Stephen John Cox, Richmond (GB)

(73) Assignee: Pandrol Limited, Addlestone Surrey (GB)

( * ) Notice: Subject to any disclaimer, the term of this patent is extended or adjusted under 35 U.S.C. 154(b) by 0 days.

(21) Appl. No.: 10/031,420

(22) PCT Filed: Jul. 20, 2000

(86) PCT No.: PCT/GB00/02810

§ 371 (c)(1),
(2), (4) Date: Apr. 24, 2002

(87) PCT Pub. No.: WO01/06061

PCT Pub. Date: Jan. 25, 2001

(30) Foreign Application Priority Data

Jul. 21, 1999 (GB) ..... 9917146

(51) Int. Cl.[7] ..... E01B 9/00
(52) U.S. Cl. ..... 238/310; 238/283
(58) Field of Search ..... 238/310, 283, 238/382

(56) References Cited

U.S. PATENT DOCUMENTS 3,358,927 A * 12/1967 Hein et al. ..... 238/283
3,525,472 A * 8/1970 Sato ..... 238/382
5,104,041 A 4/1992 Remington ..... 238/292
5,221,044 A 6/1993 Guins ..... 238/349
5,692,677 A * 12/1997 Duconseil ..... 238/283
6,079,631 A * 6/2000 Ortwein et al. ..... 238/283

FOREIGN PATENT DOCUMENTS

| | | |
|---|---|---|
| EP | 0758418 | 5/1998 |
| GB | 1481645 | 8/1977 |

* cited by examiner

*Primary Examiner*—S. Joseph Morano
*Assistant Examiner*—Lars A. Olson
(74) *Attorney, Agent, or Firm*—Gottleib, Rackman and Reisman, P.C.

(57) ABSTRACT

A railway rail fastening assembly, for suspending a railway rail (100) at discrete locations along its length above a rail foundation, comprises a pair of elastic members (5) for support the head of the rail (100), a pair of brackets (6) for applying a lateral clamping force to respective ones of the elastic members (5), a baseplate (1) having first and second shoulders (3,4), and a pair of wedge members (7), each wedge member (7) being inserted between an associated one of the shoulders (3,4) and an adjacent bracket (6) thereby to maintain the said lateral clamping force, wherein at least one (4) of the said first and second shoulders (3,4) is removable from the said baseplate (1) and is held in position on the baseplate (1) by the said lateral clamping force.

24 Claims, 10 Drawing Sheets

SUSPENDED RAIL FASTENING ASSEMBLY

BACKGROUND OF THE INVENTION

The present invention relates to a suspended rail fastening assembly.

DESCRIPTION OF THE PRIOR ART

European Patent No. EP 0 758 418 B (which corresponds to U.S. Pat. No. 6,079,631) relates to a known railway rail fastening assembly in which the head of the rail is suspended at discrete locations along its length above the rail foundation. As shown in FIG. 1 of the drawings accompanying the present application, in one embodiment of such a known assembly the rail head 100 is supported by means of a pair of elastic members 101 to which a clamping load is applied through respective brackets 102. The desired clamping load is maintained by means of respective wedges 103 inserted between each bracket 102 and an associated upstand or shoulder 104 which is fixed to an underlying rail baseplate 105 secured to a concrete sleeper 106. Such a suspended rail fastening assembly serves to reduce vibration and accordingly is advantageous in an underground railway system, for example. The applicants wish to be able to retrofit such assemblies to existing sleepers. However, this would involve not only dismantling the existing rail fastening assembly, but also lifting the rail. In an underground railway system, where there is little time available for track maintenance work without closing the track, this would be a severe disadvantage.

BRIEF SUMMARY OF THE INVENTION

According to a first aspect of the present invention there is provided a railway rail fastening assembly for suspending a railway rail at discrete locations along its length above a rail foundation, the assembly comprising a pair of elastic members for supporting the head of the rail, a pair of brackets for applying a lateral clamping force to respective ones of the elastic members, a baseplate having first and second shoulders, and a pair of wedge members, each wedge member being inserted between an associated one of the shoulders and an adjacent bracket thereby to maintain the said lateral clamping force, wherein at least one of the said first and second shoulders is removable from the said baseplate and is held in position on the baseplate by the said lateral clamping force.

Thus, since at least one of the shoulders is removable, the baseplate can be slid into position under the rail without the need to lift the rail. Similarly, the baseplate can be removed, if desired, by first removing the or each removable shoulder.

Steel baseplates for use on wooden railway sleepers are sometimes provided with one or more removable shoulders. Such baseplates have apertures in their upper surfaces for receiving the stem of a shoulder, the aperture and/or shoulder stem being configured so as to allow the shoulder to be retained on the baseplate during use whilst permitting easy removal and installation. Such removable shoulders are used in track gauge change applications or other situations where a different type or position of shoulder is required.

Many prior art removable shoulders have a hook-like stem, wider at its widest point than the aperture in the baseplate into which it is to be inserted, such that the shoulder must be rotated as it is being inserted into the aperture, but cannot be removed once installed merely by the application of a vertical force thereto. An alternative form of removable shoulder in a rail fastening assembly is disclosed in the applicants' British Patent No. GB 1 481 645 B. This type of shoulder has a stem having the shape of an inverted letter T. The stem of the shoulder is inserted into an aperture in the baseplate, the aperture having a widened end so as to accommodate the inverted T-shaped stem. The shoulder is then pushed along the aperture away from the widened end towards the rail, thereby to prevent vertical forces releasing the shoulder. However, in this and similar prior art assemblies the aperture for receiving the stem of the shoulder extends into the rail seat area so as to lie beneath the rail when it is in place.

According to a second aspect of the present invention there is provided a baseplate for use in an assembly embodying the first aspect of the present invention having one removable shoulder, which baseplate comprises a plate having a shoulder fixed on one side of a central area of the plate and an aperture formed in the plate on the other side of the central area of the plate, the aperture extending substantially away from the said central area of the plate, wherein the said aperture is shaped so as to provide, at an end thereof furthest from said central area, locating means for locating a removable shoulder on the said plate. If both shoulders of the assembly are removable, the baseplate comprises a plate having a pair of apertures formed one on each side of a central area of the plate, each aperture extending substantially away from the said central area of the plate, wherein each of the said apertures is shaped so as to provide, at an end thereof furthest from said central area, locating means for locating a removable shoulder on the said plate.

According to a third aspect of the present invention there is provided a removable shoulder for use with an assembly embodying the first aspect of the present invention or a baseplate embodying the second aspect of the present invention, wherein a portion of the shoulder which extends above the baseplate has an upright bearing face against which a lateral force bears, when the shoulder is in use, so as to hold the shoulder in a desired operative position.

BRIEF DESCRIPTION OF THE DRAWINGS

Reference will now be made, merely by way of example, to the accompanying drawings, in which.

DETAILED DESCRIPTION OF THE INVENTION

Figure 1:
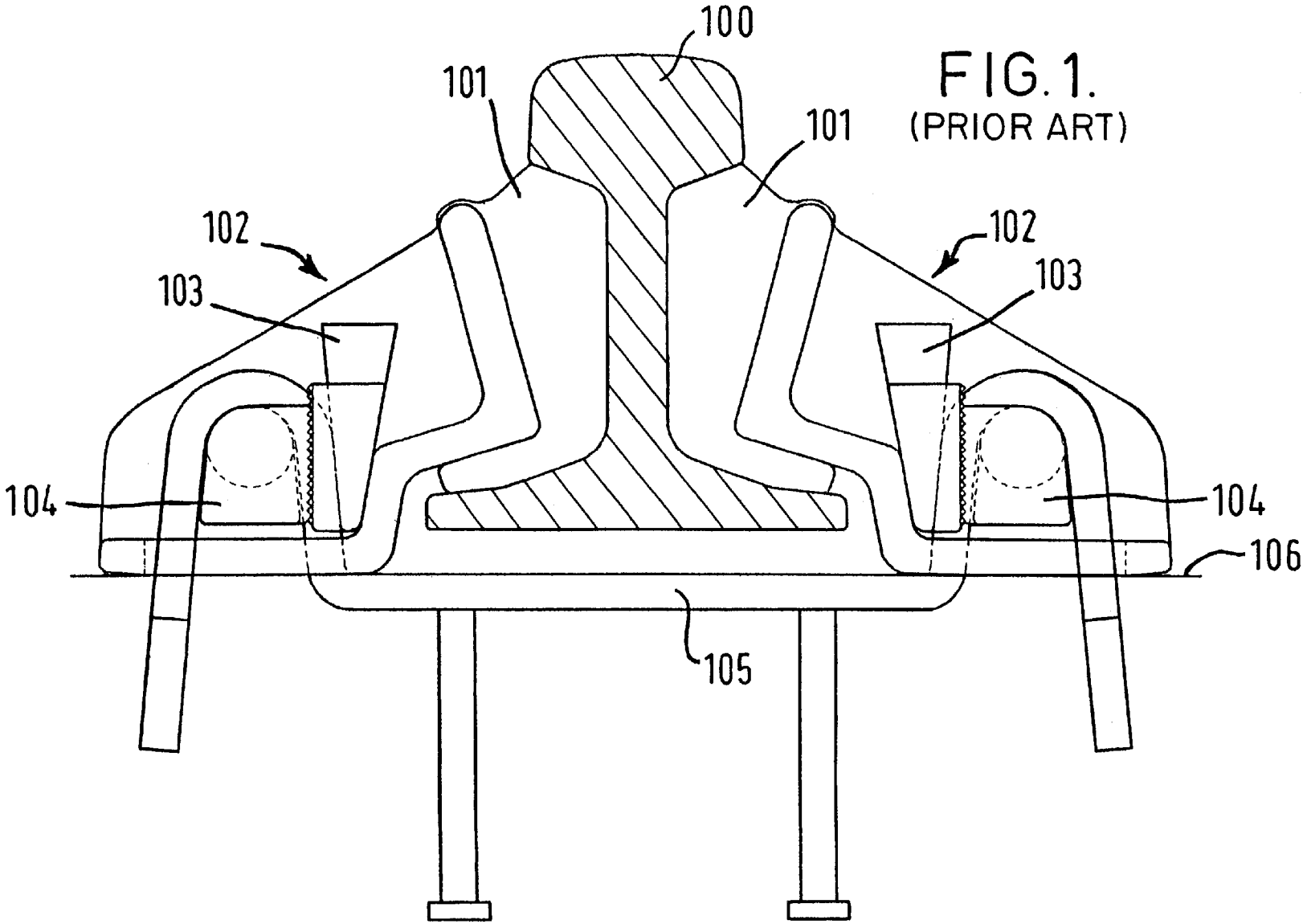
FIG. 1. (PRIOR ART)
FIG. 1 (described above) shows a prior art rail fastening assembly.
Figure 2:
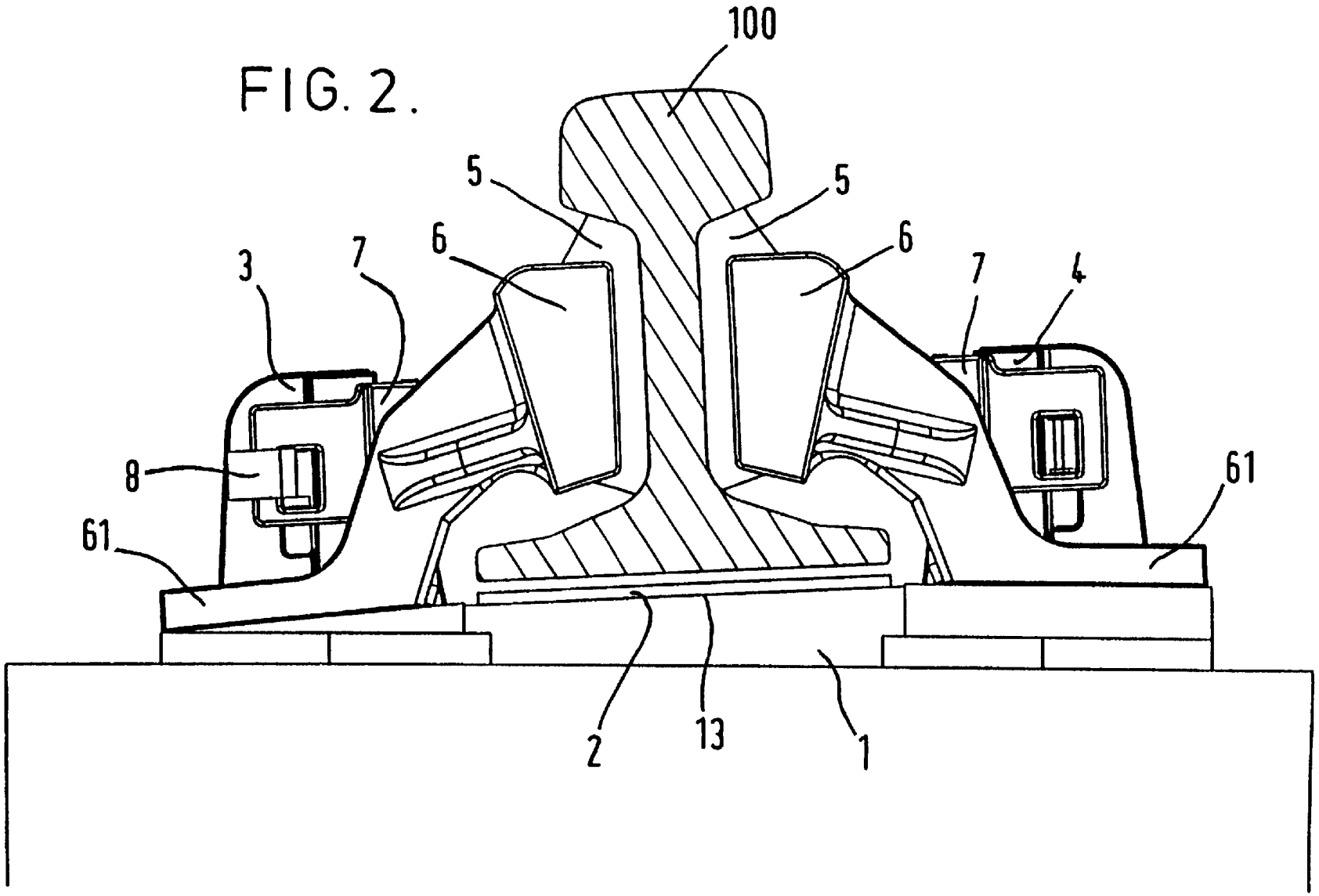
FIG. 2 shows a partial cross-sectional side view of a rail fastening assembly embodying the present invention.
Figure 3:
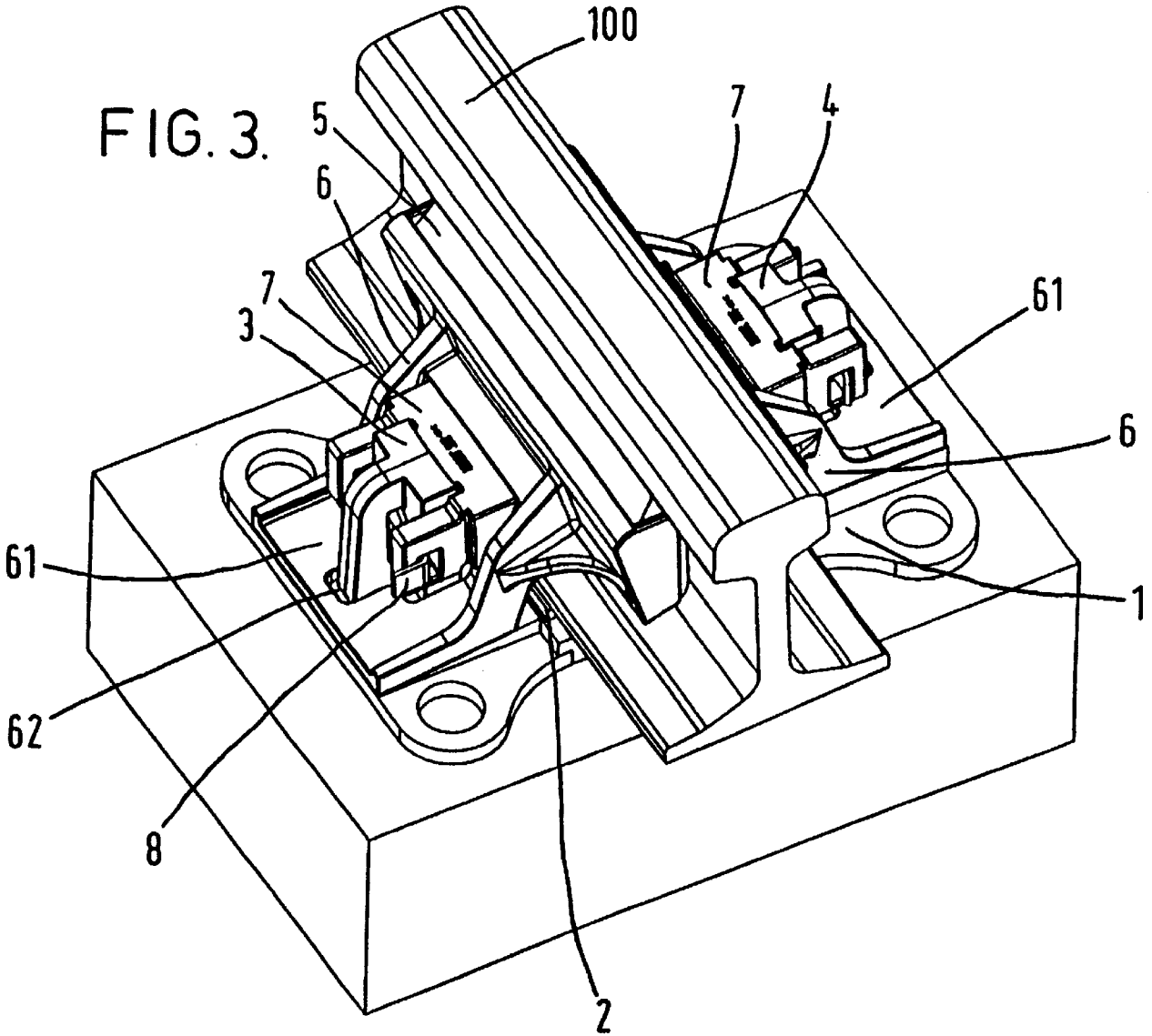
FIG. 3 shows a perspective view of the assembly of FIG. 2.

As shown in FIGS. 2 and 3 a rail fastening assembly embodying the present invention comprises a steel baseplate 1 above which a rail 100 is suspended by means of a pair of elastic members 5 to which a lateral clamping force is applied through respective brackets 6. Each bracket 6 has a base portion 61 which rests on the baseplate 1 and has a hole 62 through which a shoulder 3 or 4 extends upwardly. The desired lateral clamping force applied to the elastic members 5 is maintained by means of respective wedges 7 inserted between each bracket 6 and the adjacent shoulder 3 or 4, the wedge 7 being held in place firstly by means of interlocking serrations provided on respective opposing faces of the shoulder 3 or 4 and the wedge 7 and secondly by a securing member 8 which passes through a part 48 of the shoulder 3 or 4. As explained in more detail below, one of the shoulders 4 is removable from the baseplate 1, the shoulder 4 being installed in the baseplate 1 by inserting a stem of the shoulder 4 vertically into an aperture formed in the baseplate 1 and sliding the shoulder 4 laterally away from the rail area into engagement with the baseplate 1. The lateral clamping force applied to the elastic members 5 also serves to keep the removable shoulder 4 firmly in position against the back of the aperture.

Figure 4A:
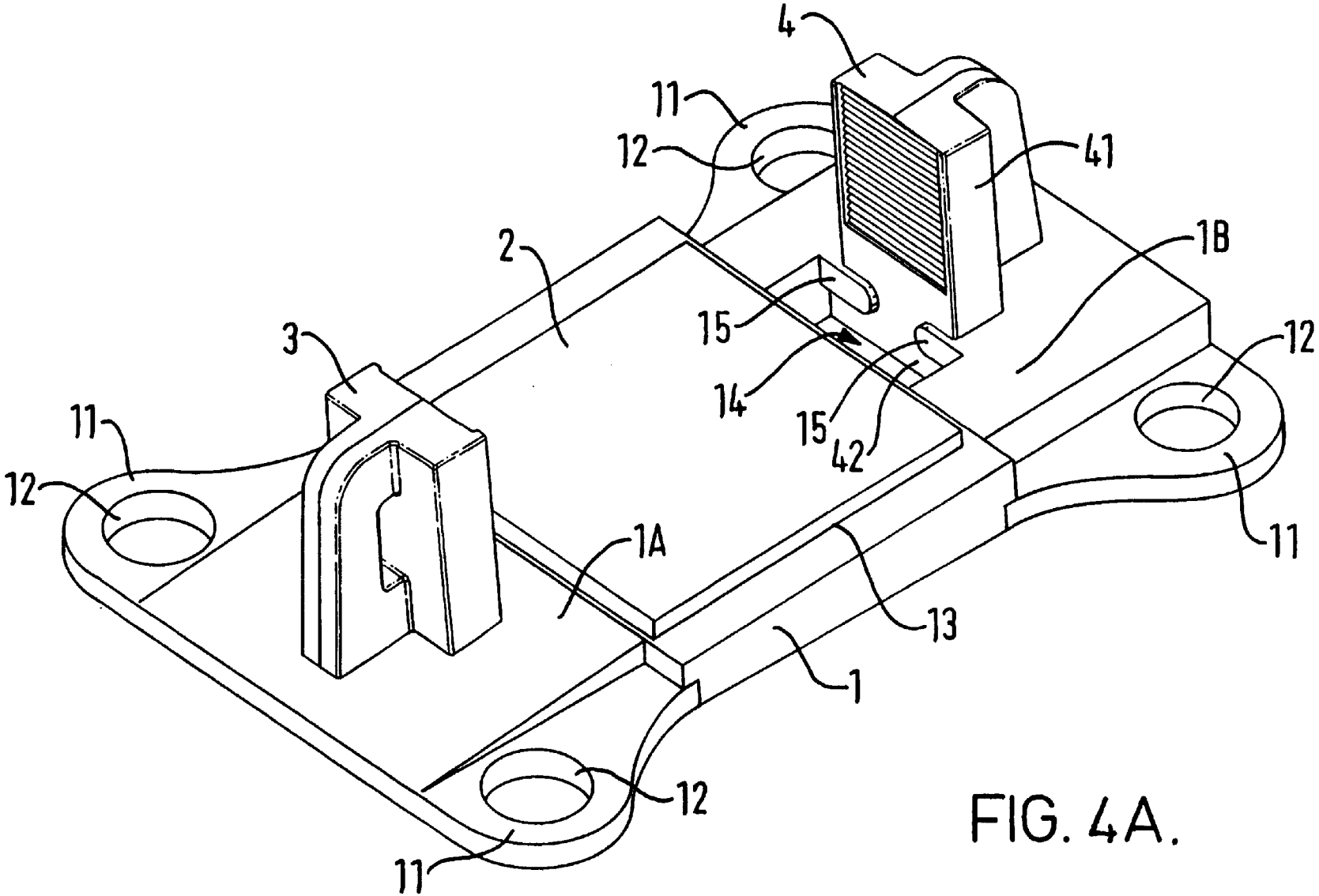
FIGS. 4A and 4B show perspective views of part of a rail fastening assembly embodying the present invention.
Figure 4B:
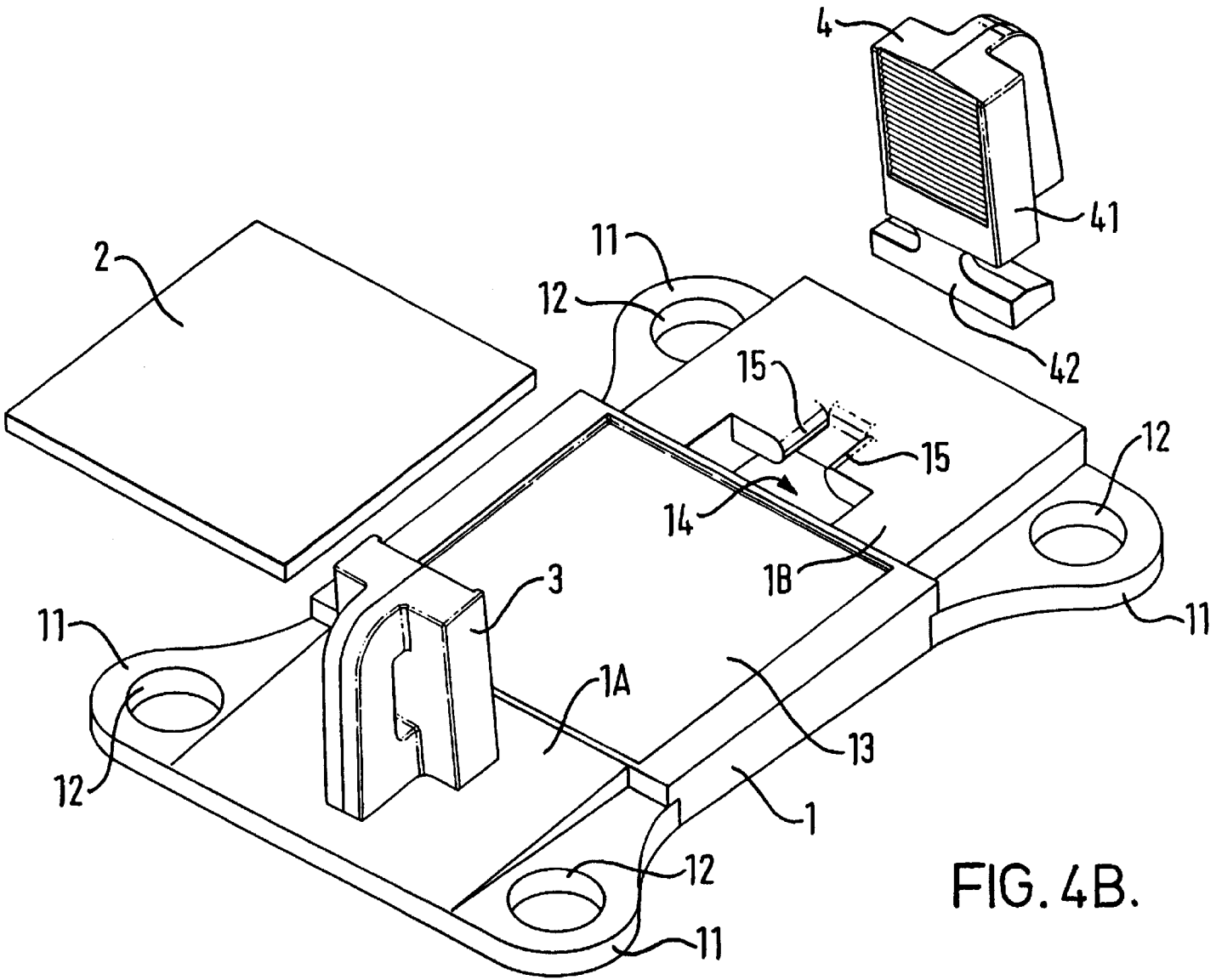

FIGS. 4A and 4B show in more detail part of a railway rail fastening assembly embodying the present invention. The steel baseplate 1 is approximately rectangular in shape except at the corners where the baseplate 1 has ears 11 formed with respective holes 12 for receiving bolts whereby the baseplate can be secured for example to an underlying wooden railway sleeper when the assembly is in use. The centre of the baseplate is formed with a recess 13 for receiving a resilient rail pad 2. Extending upwardly from the base plate 1 on one side 1A of the recess 13 is a fixed shoulder 3. On the other side 1B of the recess 13 a removable shoulder 4 is provided, a stem of the shoulder 4 being located in a aperture 14 in the baseplate 1. The thickness of the baseplate 1 is greater in the region of the aperture 14 than in the region of the fixed shoulder 3 so as to accommodate the stem of the removable shoulder 4.

Preferably, as shown here, the upper surface of the baseplate 1 in the region 1B of the aperture 14 is flat and parallel to the bottom face 1C of the baseplate 1, so that it is both as strong and as thin as possible whilst allowing sufficient depth for the stem of the removable shoulder 4. When in use the removable shoulder 4 is held within the aperture 14 such that its front face extends substantially perpendicularly with respect to the recess 13.

Figure 7:
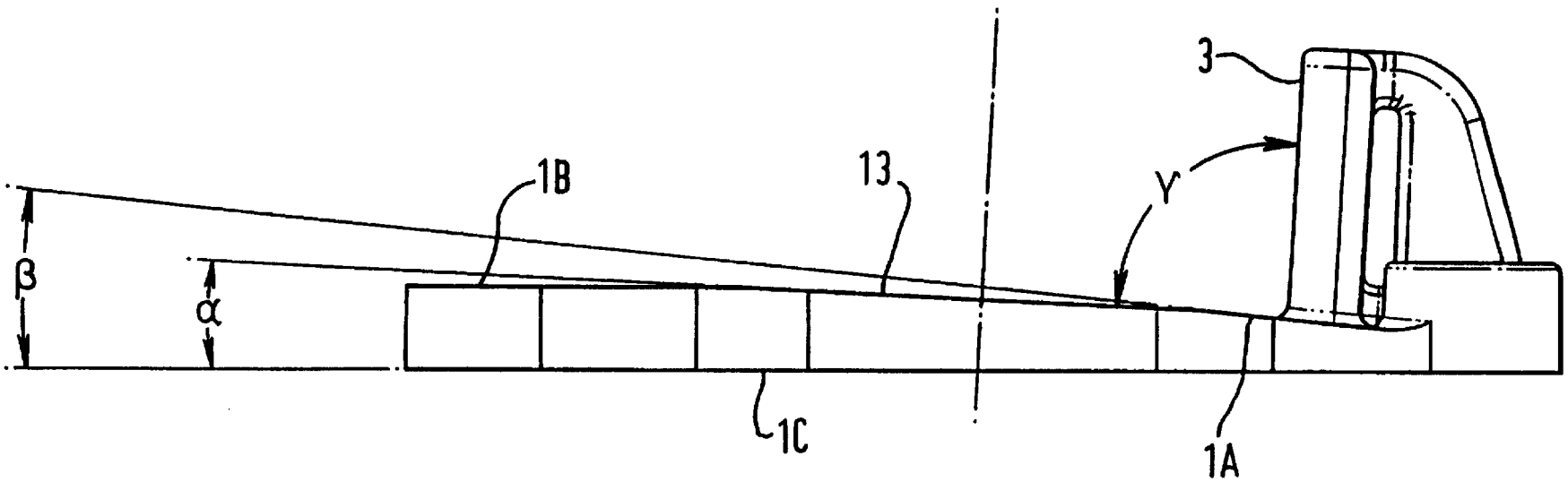
FIG. 7 shows an opposite side view of a baseplate for use in an embodiment of the present invention.

In many cases in track the rail is inclined, but the surface on which the assembly is fitted is horizontal. In order to achieve such inclination of the rail in the present embodiment, the recess 13 of the baseplate 1 has an upper face which is inclined with respect to the bottom face 1C of the baseplate 1 at an angle a as shown in FIG. 7. Typically a is approximately 2.9°. In such circumstances, in order to allow the use of identical brackets 6 and elastic members 5 on both sides of the assembly, the upper surface of the baseplate 1 in the region 1A of the fixed shoulder 3 is inclined with respect to the upper surface of the baseplate 1 in the region 1B of the aperture 14 at an angle $\beta$ which is substantially twice the angle of inclination of the baseplate 1 in the region of the recess 13. Typically, if $\alpha$ is approximately 2.9°, $\beta$ is approximately 5.8°. The fixed shoulder 3 extends substantially perpendicularly with respect to the upper surface of the recess 13, i.e. $\gamma \sim 90°$. Thus, the angle between the front face of each shoulder 3, 4 and the local surface of the baseplate 1 on both sides of the baseplate 1 is $\sim 90° - \alpha$, and the angle between the front face of each shoulder 3, 4 and the recess 13 is ~90°.

Figure 5:
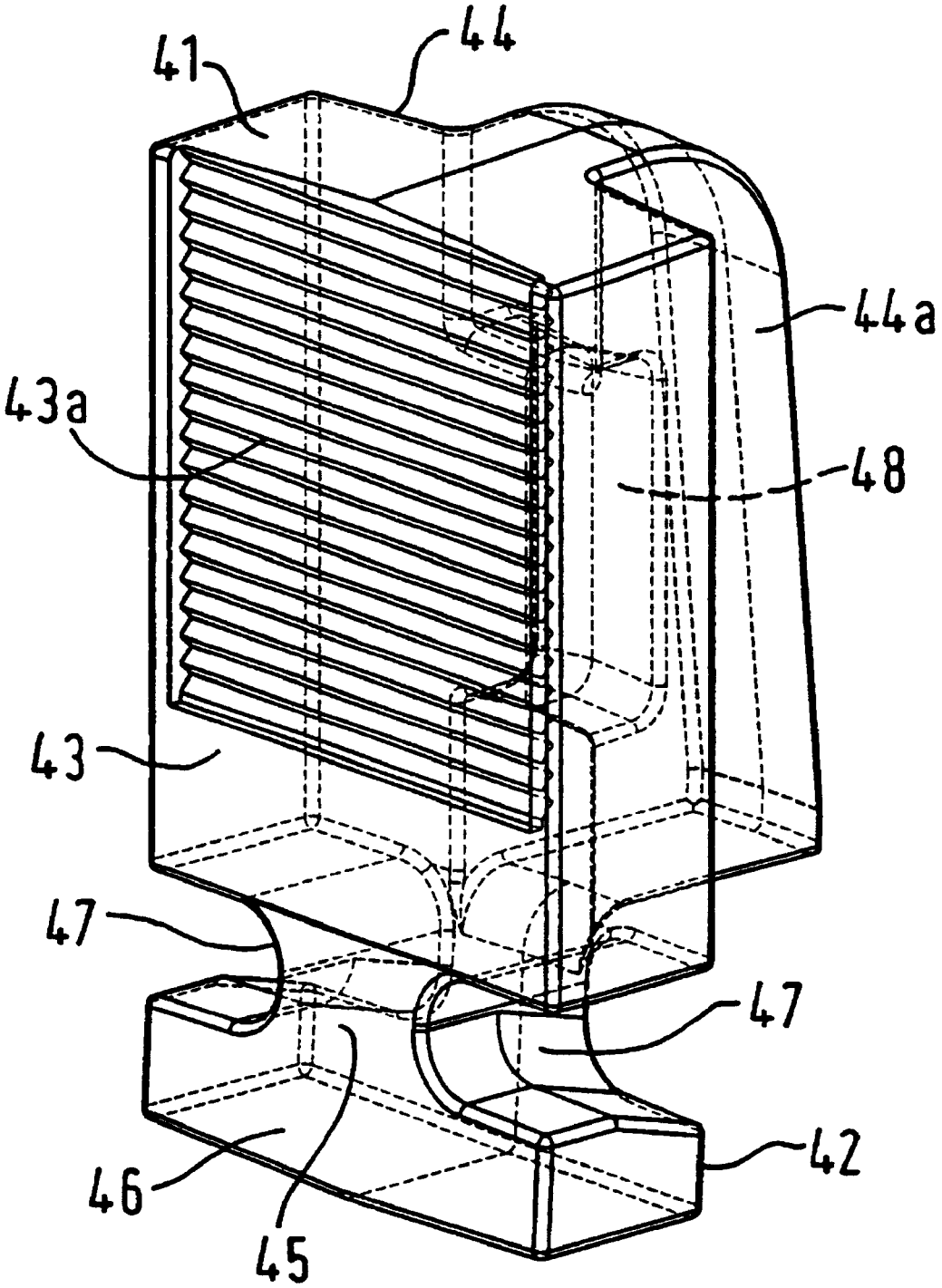
FIG. 5 shows a perspective view of a shoulder for use in an embodiment of the present invention.

The removable shoulder 4 is shown in more detail in FIG. 5 and comprises an upper part 41, which extends above the upper surface of the baseplate 1, and a lower part or stem 42 which locates the shoulder 4 in the aperture 14 of the baseplate 1. The upper part 41 of the shoulder 4 has a front face 43, which faces the rail when in use, bearing serrations 43*a* which engage with corresponding serrations on the wedge 7. From a rear face 44 of the upper part 41 of the shoulder 4 there extends a support portion 44*a* which, when the shoulder is in use, bears against the upper surface of the baseplate 1 to support the shoulder 4. The support portion 44*a* has a hole through it for receiving the securing member 8 of the assembly. The stem 42 of the shoulder 4 has approximately the form of an inverted letter T such that the stem 42 has a central post 45 with a widened end 46 above which are formed, on either side of the central post 45, respective grooves 47 for receiving cooperating elongate projections 15 (see below) formed in the aperture 14 of the baseplate 1, thereby to retain the shoulder 4 in the aperture 14.

Figure 6:
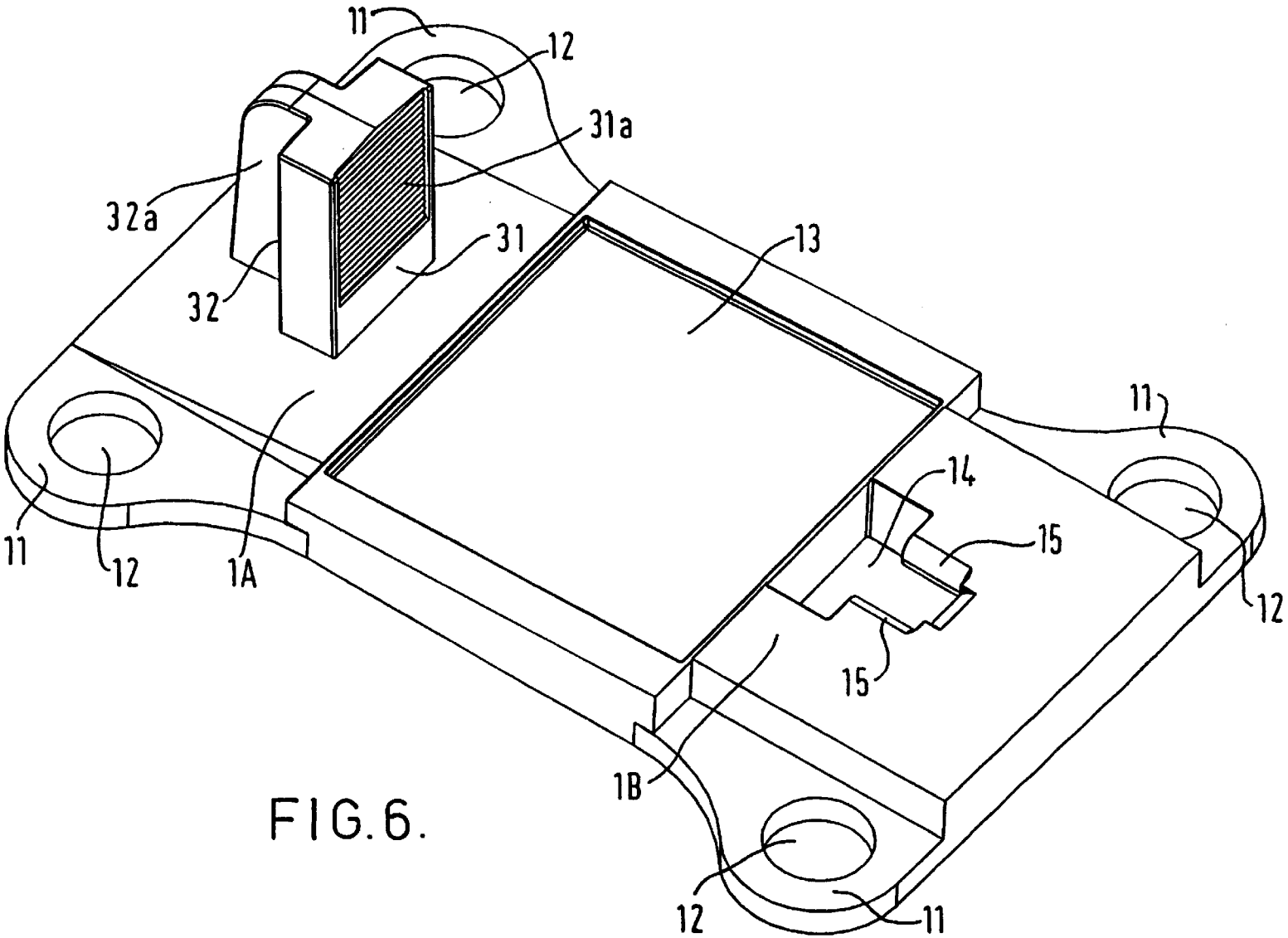
FIG. 6 shows a perspective view of a baseplate for use in an embodiment of the present invention.

The baseplate 1 is shown in more detail in FIG. 6, from which it can be seen that the fixed shoulder 3 has a front face 31, which faces the rail when in use, bearing serrations 31*a* which engage with corresponding serrations on the wedge 7. A rear face 32 of the fixed shoulder 3 has a part 32*a* through which there is a hole for receiving the securing member 8 of the assembly. One end of the aperture 14 closest to the recess 13 is wider than the other, such that in plan the aperture 14 in the base plate 1 has substantially the shape of a letter T, owing to the presence of the pair of elongate projections 15 which cooperate with respective grooves 47 of the stem 42 of the shoulder 4. The wider end of the aperture 14 is just wide enough to receive the widened end 46 of the stem 42 of the shoulder 4 so it can moved vertically into or out of the aperture without rotation.

Figure 8:
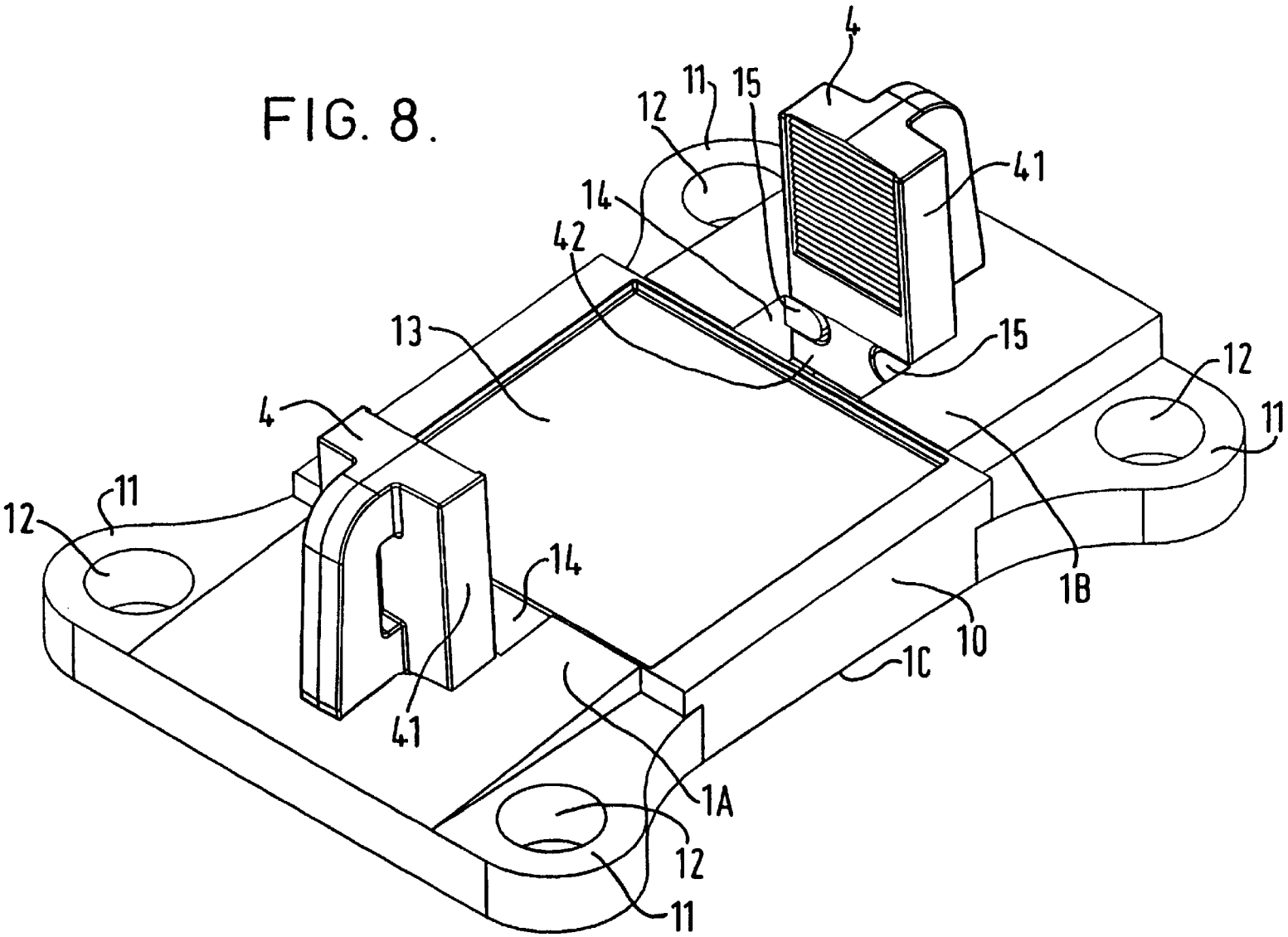
FIG. 8 shows a perspective view of part of a rail fastening assembly including two of the shoulders of FIG. 5 and a modified version of the baseplate of FIG. 6.
Figure 9:
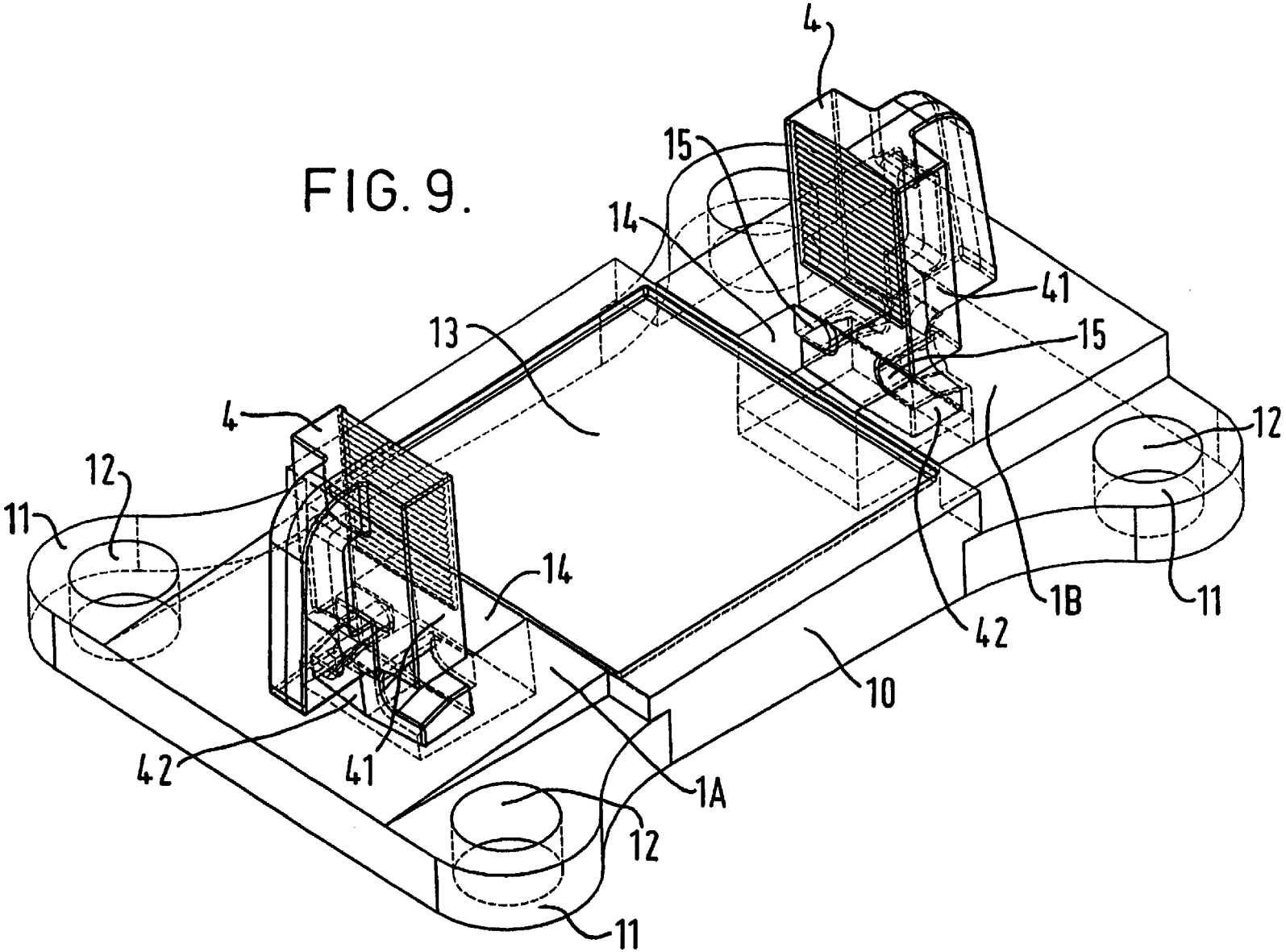

FIGS. 8 and 9 show a modification of the baseplate 1. In this alternative embodiment, in place of the fixed shoulder 3, the modified baseplate 10 has a second aperture 14 and a second removable shoulder 4. The baseplate 10 is thickened in the region of the second aperture 14 as compared with the earlier-described baseplate 1 so as to accommodate the second removable shoulder 4. Thus, in this embodiment greater flexibility is achieved through the ability to remove both shoulders 4 if desired.

What is claimed is:

1. A railway rail fastening assembly for suspending a railway rail at discrete locations along its length above a rail foundation, the assembly comprising a pair of elastic members for supporting the head of the rail, a pair of brackets for applying a lateral clamping force to respective ones of the elastic members, a baseplate having first and second shoulders, and a pair of wedge members, each wedge member being inserted between an associated one of the shoulders and an adjacent bracket thereby to maintain said lateral clamping force, wherein at least one of said first and second shoulders is removable from said baseplate and is held in position on the baseplate by said lateral clamping force.

2. An assembly as claimed in claim 1, wherein both said first and second shoulders are removable.

3. An assembly as claimed in claim 1, wherein a base portion of each bracket is provided with a hole through which the associated shoulder extends upwardly.

4. An assembly as claimed in claim 1, wherein interlocking serrations are provided on a part of each of said wedge members and each of said first and second shoulders so as to retain each wedge member in a desired disposition with respect to the associated shoulder.

5. An assembly as claimed in claim 1, wherein said shoulders and said wedge members are provided with respective holes for receiving securing members therethrough, whereby said wedge members are secured to said shoulders.

6. An assembly as claimed in claim 1, wherein said baseplate comprises a plate having a shoulder fixed on one side of a central area of the plate and an aperture formed in the plate on the other side of the central area of the plate for accommodating a removable shoulder, the aperture extending substantially away from said central area of the plate, wherein said aperture is shaped so as to provide, at an end thereof furthest from said central area, locating means for locating the removable shoulder on said plate.

7. An assembly as claimed in claim 6, wherein the plate is thicker in the region of the aperture than in the region of the fixed shoulder.

8. An assembly as claimed in claim 6, wherein a bearing face of the fixed shoulder has serrations.

9. An assembly as claimed in claim 6, wherein the upper surface of said central area is inclined with respect to the bottom face of the baseplate by a first angle $\alpha$, and the upper surfaces of the plate on each side of said central area are inclined with respect to each other at a second angle $\beta$, where $\beta=2\alpha$.

10. An assembly as claimed in claim 9, wherein the upper surface of the side of the plate through which said aperture extends is parallel to the bottom face of the baseplate.

11. An assembly as claimed in claim 2, wherein said baseplate comprises a plate having a pair of apertures formed one on each side of a central area of the plate, each aperture extending substantially away from said central area of the plate, wherein each of said apertures is shaped so as to provide, at an end thereof furthest from said central area, locating means for locating a respective removable shoulder on said plate.

12. An assembly as claimed in claim 11, wherein the upper surface of said central area is inclined with respect to the bottom face of the baseplate by a first angle $\alpha$, and the upper surfaces of the plate on each side of said central area are inclined with respect to each other at a second angle $\beta$, where $\beta=2\alpha$.

13. An assembly as claimed in claim 12, wherein the upper surface of one of the sides of the plate through which one of said apertures extends is parallel to the bottom face of the baseplate.

14. An assembly as claimed in claim 6, wherein the bearing face of each shoulder extends substantially perpendicularly with respect to said central area when the baseplate is in use.

15. An assembly as claimed in claim 6, wherein the aperture for accommodating the removable shoulder is shaped in plan substantially like a letter T.

16. An assembly as claimed in claim 6, wherein said locating means are formed so as to interlock with cooperating means provided on said removable shoulder.

17. An assembly as claimed in claim 1, wherein a portion of said at least one removable shoulder which extends above the baseplate has an upright bearing face against which a lateral force bears, when said at least one removable shoulder is in use, so as to hold that removable shoulder in a desired operative position.

18. An assembly as claimed in claim 17, wherein said bearing face is serrated.

19. An assembly as claimed in claim 17, wherein said at least one removable shoulder includes a respective stem having means for interlocking with an associated locating means on said baseplate thereby to locate said at least one removable shoulder on the baseplate.

20. An assembly as claimed in claim 11, wherein each aperture for accommodating a removable shoulder is shaped in plan substantially like a letter T.

21. An assembly as claimed in claim 11, wherein said locating means of each aperture are formed so as to interlock with respective cooperating means provided on said removable shoulders.

22. An assembly as claimed in claim 2, wherein a portion of each removable shoulder which extends above the baseplate has an upright bearing face against which a lateral force bears, when that removable shoulder is in use, so as to hold the said removable shoulder in a desired operative position.

23. An assembly as claimed in claim 22, wherein said bearing face on each removable shoulder is serrated.

24. An assembly as claimed in claim 22, wherein each removable shoulder includes a respective stem having means for interlocking with an associated locating means on said baseplate thereby to locate that removable shoulder on the baseplate.

* * * * *